US006686561B2

(12) United States Patent
Horey et al.

(10) Patent No.: US 6,686,561 B2
(45) Date of Patent: Feb. 3, 2004

(54) TEMPERATURE COMPENSATION WARMING FABRIC

(75) Inventors: Leonard I. Horey, Boca Raton, FL (US); Armando Alvite, Miami Lakes, FL (US); Gabriel S. Kohn, Boca Raton, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

(21) Appl. No.: 10/160,624

(22) Filed: May 31, 2002

(65) Prior Publication Data

US 2003/0222068 A1 Dec. 4, 2003

(51) Int. Cl.[7] ..... H05B 3/34

(52) U.S. Cl. ..... 219/212; 219/202; 219/387; 219/528; 219/494; 5/421; 165/240

(58) Field of Search ..... 219/202, 203, 219/205, 212, 387, 494, 528–529, 531, 535–537, 544, 546; 5/421–422, 482; 165/240, 242

(56) References Cited

U.S. PATENT DOCUMENTS 2,522,826 A * 9/1950 Hooven ..... 219/499
2,794,896 A 6/1957 Huck
3,462,585 A 8/1969 Somers
4,251,718 A 2/1981 Cole
4,450,496 A 5/1984 Doljack et al.
4,455,472 A 6/1984 Moss
4,677,281 A * 6/1987 Mills ..... 219/505
5,070,932 A * 12/1991 Vlasak ..... 165/29
5,403,992 A 4/1995 Cole
5,410,127 A * 4/1995 LaRue et al. ..... 219/212
5,850,644 A * 12/1998 Hsia ..... 5/422

* cited by examiner

*Primary Examiner*—Shawntina Fuqua
(74) *Attorney, Agent, or Firm*—Lawrence J. Shurupoff

(57) ABSTRACT

Disclosed is a warming blanket system having a fabric comprising a heating element, a data temperature mechanism configured to provide ambient air temperature data, a user input configured to provide user heat output preference data for a given normal ambient temperature, and a control system configured to input said air temperature and user heat output preference data and adjust heat output to said heating element based upon a deviation of a measured ambient temperature from said normal ambient temperature.

31 Claims, 3 Drawing Sheets

TEMPERATURE COMPENSATION WARMING FABRIC

FIELD OF THE INVENTION

The present invention relates generally to fabrics, and more particularly to electric heating fabrics such as electric blankets.

BACKGROUND OF THE INVENTION

In general, an electric blanket, a warming blanket, or an electric heating blanket, is a blanket containing an insulated electric heating element. An electric blanket is typically plugged into a power outlet so that power may be supplied to the heating element, causing the production of heat. In this manner, the electric blanket may be a warm, comfortable cover, or may be used to warm a bed, for example.

Contemporary electric blankets usually include controls that permit a user to set the amount of heat output of the blanket. This feature allows the consumer to set the blanket to a setting that offers the desired amount of heat for a particular temperature and in accordance with the comfort level of the individual.

Although present electric blankets work well for their intended purpose, often they are uncomfortable for a user when there are temperature changes after the controls for the blanket have been set. For example, a user may utilize an electronic thermostat for the home that is programmable to cause the temperature of the house to decrease during the night, and to increase the temperature of the house just prior to a wakening time. Such temperature changes may not be taken into account by the manufacturer of the electric blanket, and a heat output setting that was comfortable when the electric blanket was set (e.g., when the room was 70 degrees) may not be comfortable when the room temperature decreases during the night (e.g., drops to 60 degrees). As such, the user may feel cold during the night when the temperature drops to the lower temperature. The user may reset the blanket to a higher setting, but changing the setting may require waking up during the night, finding the controls for the electric blanket, and setting the controls to the new setting. Moreover, the new, higher setting may be uncomfortably warm when the room temperature returns to a higher setting (e.g., 70 degrees) in the morning.

SUMMARY OF THE INVENTION

The present invention provides a warming fabric having temperature compensation controls that vary the heat output of the warming fabric to adjust for changes in ambient temperature. To this end, the present invention utilizes a thermistor or another mechanism that is configured to generate information about the temperature of the location of the fabric (temperature data mechanism). In the case of the thermistor, because resistance varies with temperature of the thermistor, fixed current applied to the thermistor will vary the voltage reading across the thermistor with changes in temperature. This information may be used to generate temperature data. For example, a thermistor and a fixed series resistor may be connected in series to a fixed voltage, and the voltage at the junction of the thermistor and the series resistor may be measured and supplied to a microcomputer. Because the thermistor's resistance varies with temperature, the voltage at the junction varies with the temperature changes.

In accordance with one aspect of the present invention, the relationship between the temperature and the output of the temperature data mechanism is approximately linear over the typical operating temperature range where most blankets are used (e.g., 50 to 80 degrees Fahrenheit). In the case of the thermistor described above, the approximately linear information is the voltage at the juncture of the two resistors. This juncture is connected to a microcomputer that programmed to set the heat output of the warming fabric. An A/D converter converts the analog voltage reading at the juncture into a digital value. The microcomputer may then use the digital value to determine how the fabric heat output should be modified due to the ambient temperature. To do so, a look up table or an algorithm may be used to calculate the appropriate heat output.

The combination of the fixed resistor and the thermistor require very little additional PC board area and may be added to existing controls with little effort or cost. As such, the present invention provides a relatively inexpensive warming fabric control that may easily adjust for varying ambient temperature conditions.

Other advantages will become apparent from the following detailed description when taken in conjunction with the drawings, in which:

DETAILED DESCRIPTION

In the following description, various aspects of the present invention will be described. For purposes of explanation, specific configurations and details are set forth in order to provide a thorough understanding of the present invention. However, it will be apparent to one skilled in the art that the present invention may be practiced without the specific details. Furthermore, well-known features may be omitted or simplified in order to not obscure the present invention.

Figure 1:
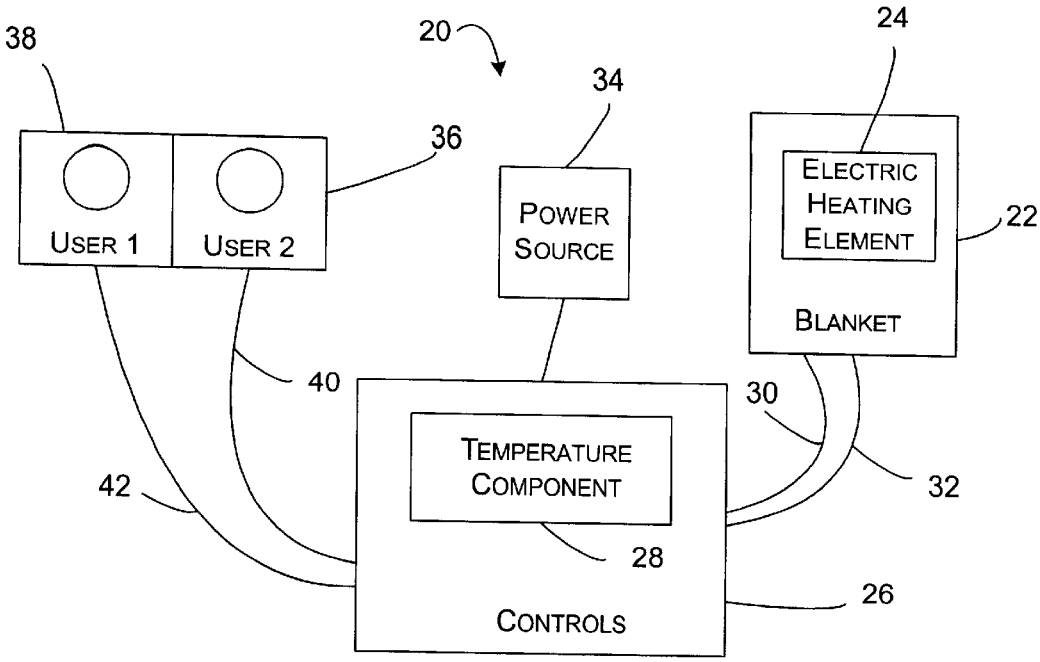
FIG. 1 is a block diagram representation of a warming fabric and controls therefor incorporating the present invention.

Referring now to the drawings, in which like reference numerals represent like parts throughout the several views, FIG. 1 shows a warming fabric 20 incorporating the present invention. The warming fabric 20 includes a blanket 22, made of a natural or synthetic material, such as a polyester/acrylic blend, or another suitable fabric or blend of material. An electric heating element 24 is included in the blanket, the construction and operation of which is known in the art. As used herein, however, a heating element is any device or structure that may produce heat using electrical power. Also, although a blanket is described with respect to the embodiment shown, the blanket 22 may be a heated throw or mattress pad, or any other type of fabric that may be heated, and may be sized to fit any size of bed, may be configured as a throw, or as convenient.

The warming fabric 20 includes controls 26 having a temperature component 28. One or more power cords 30, 32 lead from the controls 26 to the blanket 22. A power source 34 is connected to the controls 26, and may be provided, for example, via a DC converter connected to an AC outlet, or via another DC source.

One or more user controls 36, 38 are provided, and are attached to the controls 26 via wires 40, 42, although a wireless connection may be used. The user controls 36, 38 may be any type of configuration that permits a user to input a desired setting for the warming fabric 20, e.g., dials, slide bars, push-button indexing units with digital or LED displays, and so forth. In the embodiment shown in FIG. 1, two user controls are shown, which may be used, for example, on a blanket having two different heating zones. However, if a single zone blanket is used, then only one user control (e.g., 36) is needed, along with the corresponding wire (e.g., 40), or wireless connection, if relevant. In such an embodiment, only one power cord (e.g., 30) is needed for the blanket. Various other combinations may be configured by a person of skill in the art.

Briefly described, in accordance with one aspect of the present invention, the controls 26 and the temperature component 28 are configured such that the temperature component 28 supplies ambient temperature information to the controls 26, and the controls adjust the heat output of the blanket 22 according to the temperature information. To this end, the controls 26 include a temperature compensation component that adjusts the heat output according to the temperature information. Although the temperature component 28 is shown as being a part of the controls 26, it may be provided as a module that is separate from the controls 26, and may be mounted or placed where convenient. However, preferably the temperature component 28 is mounted where it is spaced from the blanket 22 so that it is not heated by operation of the heating element 24. Instead, it is preferred that the temperature component 28 respond to changes in ambient, or surrounding, temperatures of the blanket 22.

Figure 2:
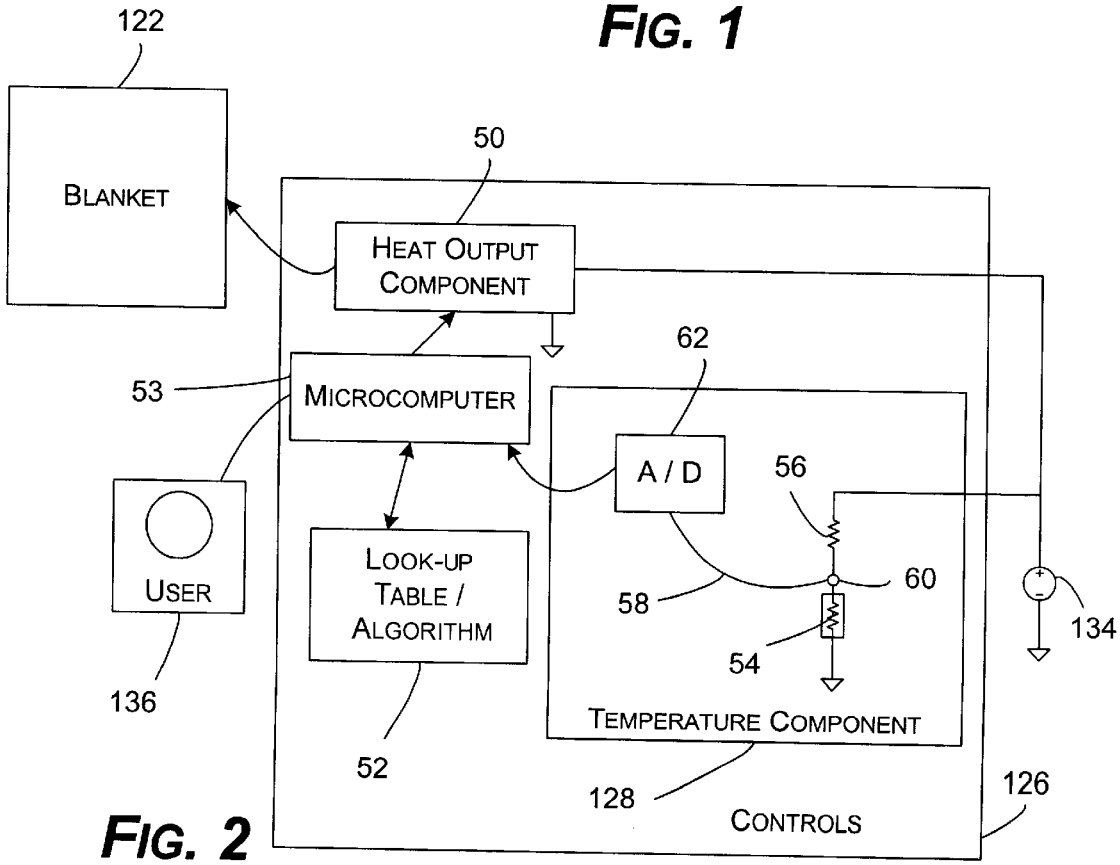
FIG. 2 is a block diagram representation of the controls of FIG. 1.

FIG. 2 shows an embodiment of the invention utilizing a single user control 136 with a blanket 122. The controls 126 for the shown embodiment are attached to a DC power source 134 and, in addition to the temperature component 128, include a heat output component 50, a look-up table or algorithm 52, and a microcomputer 53. The microcomputer 53 is a standard control (i.e., a device or mechanism used to regulate or guide the operation of a machine, apparatus, or system) or other device that can execute computer-executable instructions, such as program modules. Generally, program modules include routines, programs, objects, components, data structures and the like that perform particular tasks or implement particular abstract data types.

The temperature component 128 shown in FIG. 2 includes a thermistor 54 wired in series with a fixed series resistor 56 to the DC power source 134. A wire 58 connects to the junction 60 of the two resistors, and an A/D converter 62 is connected to the wire. The A/D converter 62, in turn, is arranged to send signals to the microcomputer 53, either through a hard-wired connection or via a wireless transmission. Alternatively, the A/D converter 62 may be contained within the microcomputer 53 in a manner known in the art.

The fixed series resistor 56 may be, for example, a 100 K ohm resistor. A thermistor is a resistor whose resistance varies with temperature. As an example, for the embodiment shown in FIG. 2, the thermistor may be a 100 K ohm thermistor, having a resistance of approximately that value at 77 degrees Fahrenheit, a higher resistance at lower temperatures (e.g., 157 K ohm at 60 degrees Fahrenheit), and a much lower resistance at higher temperatures (e.g., 81 K at 86 degrees Fahrenheit). While the resistance of the thermistor 54 typically does not vary linearly with changes in temperature, preferably its variation is close to linear over the typical operating range of a warming fabric, e.g., 55 to 80 degrees Fahrenheit. Applicants have found that the thermistor set forth in this paragraph displays such properties.

Figure 3:
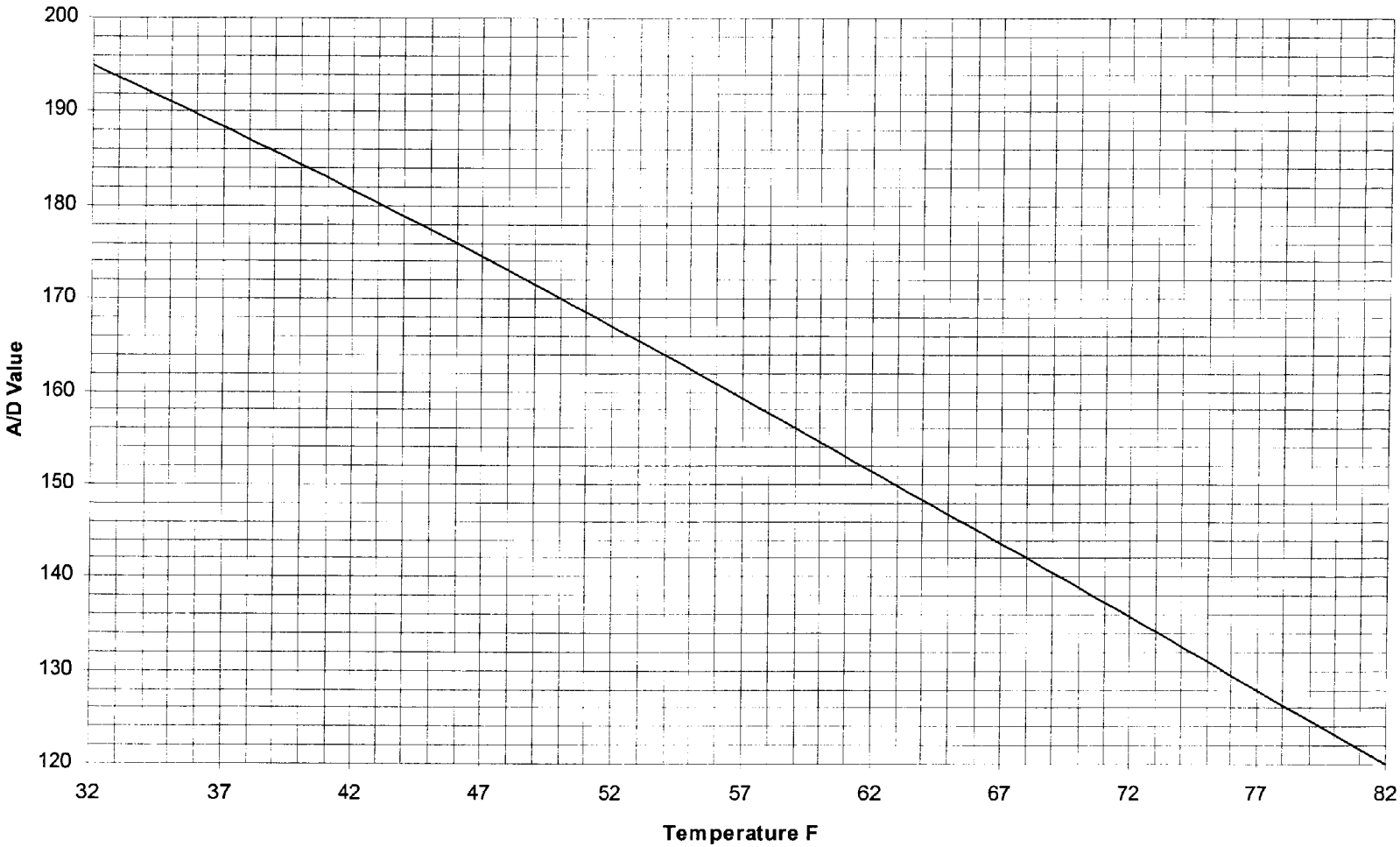
FIG. 3 is a graphical representation of a digital representation of voltage verses temperature for a temperature control unit of the controls of FIG. 2.

The A/D converter 62 is configured to convert an analog voltage reading from the juncture 60 of the two resistors to a digital value representing the voltage. Because the thermistor's resistance varies approximately linearly, the voltage at the juncture 60 varies approximately linearly. As an example, FIG. 3 is a graphical representation of voltage information at the juncture, verses temperature at the juncture, for a fixed voltage supplied by the DC power source 134.

In accordance with one aspect of the present invention, the digital information generated by the A/D converter 62 is used to represent temperature information. The digital voltage information changes substantially the same as changes in temperature, because, as described above, the resistance of the thermistor varies close to linearly over the operating temperature range of the warming fabric 20. The digital voltage information may therefore be used to represent the ambient temperature of the warming fabric. This digital voltage information is used by the heat output component to determine the amount of adjustment to the heat output of the blanket that is needed to offset variations in temperature from a normal ambient temperature, as described further below.

Although the described embodiment utilizes a thermistor 54 to provide the temperature information, other mechanisms configured to generate information about the temperature of the location of the blanket may be used. As used herein, such mechanisms are referred to as "temperature data mechanisms." One example would be a digital thermometer. Another would be a Positive Temperature Coefficient (PTC) wire or other device that varies resistance with temperature. However, the shown embodiment that utilizes a thermistor is particularly inexpensive, and requires very little hardware for use. In addition, the components of the temperature component may be mounted on a conventional PC board, requiring little space. Moreover, the thermistor of the present invention exhibits a nearly linear variation of resistance with changes of temperature.

Figure 4:
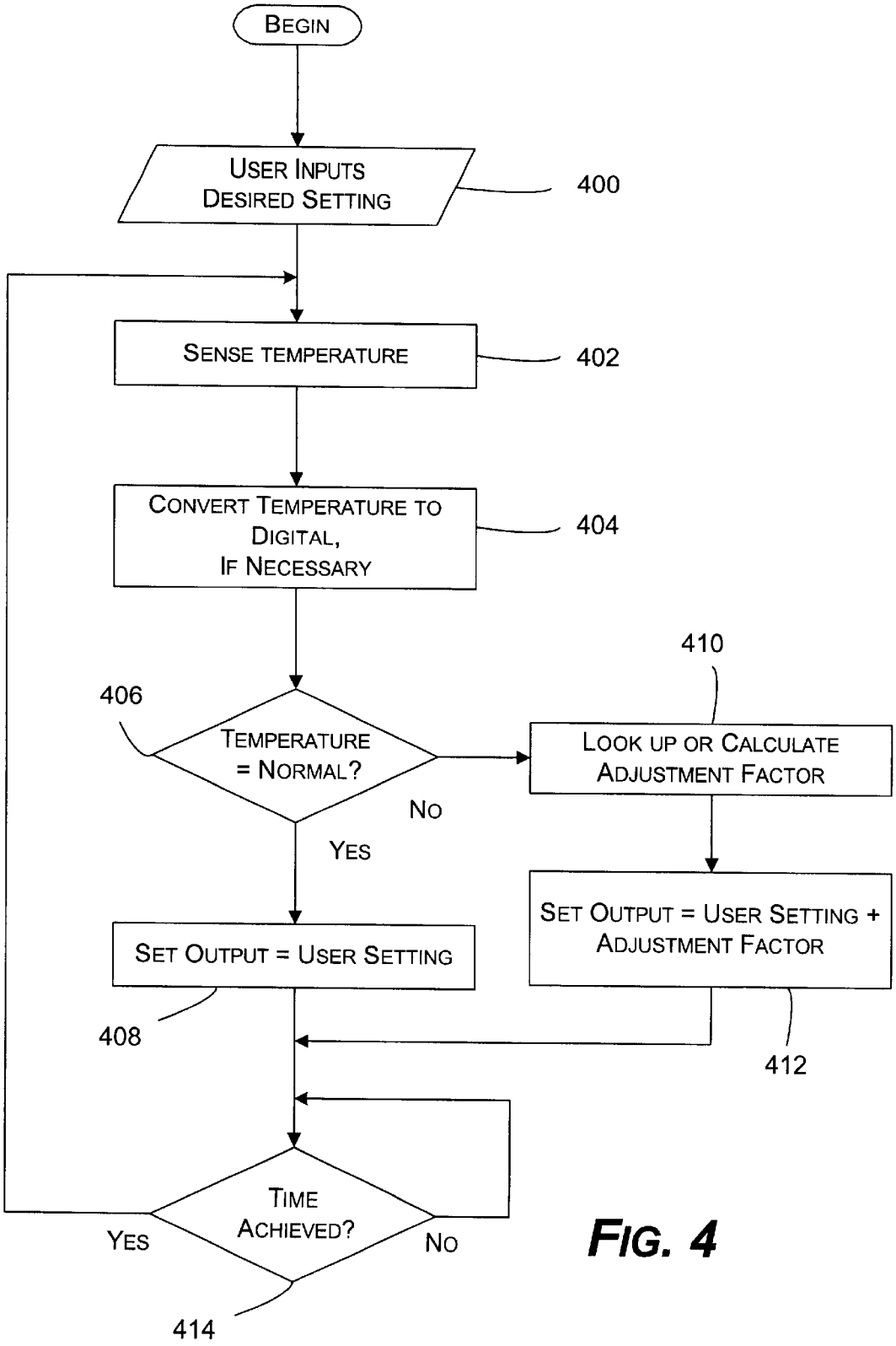
FIG. 4 is a flow diagram generally representing steps of operation of the controls of the warming fabric of FIG. 1 in accordance with one aspect of the present invention.

FIG. 4 shows a general overview of operation of the temperature compensation controls of the warming fabric 20 in accordance with one aspect of the present invention. Beginning at step 400, a user enters a desired setting (e.g., via the user control 36). The setting represents a comfort level chosen by the user, and is stored in the microcomputer 53. As an example, the user control 36 may include settings 1 to 10, with 10 being the warmest setting, and 1 being the least warm. These settings represent the power setting of the warming fabric. That is, the amount of power that is supplied to the heating element 24, and thus the heat output of the warming fabric 20. As one example, the settings may represent the amount of time (the "duty cycle") that power is supplied to the electric heating element 24 during a fixed time period, such as 90 seconds. For a setting of 10, the time that power is supplied to the heating elements during the time period is longer than a setting of 9, 9 is longer than 8, and so forth. As one example, at the setting 10, the power may be supplied to the blanket for the entire time period. For a low setting, such as 1, the power may be supplied for only 10% of the duty cycle. The remaining settings may increase the duty cycle linearly as the setting increases (e.g., 20% at 2, 30% at 3, and so forth). The microcomputer 53 may be programmed by a programmer of skill in the art to provide the heat output settings and other functions described herein.

Operating a warming fabric at different heat output settings is known, and other ways of modifying the power to the heating elements may be used, and the above is given as an example only. For example, the amount of power cycled to the heating element may be reduced, instead of the time the power is supplied to the heating element. In addition, more than one heating element or alternate arrangements for one or more heating elements may be used, and lower settings may use a first heating element, intermediate settings the second, and higher settings a combination of the two.

In any event, at step 402, the temperature is sensed (e.g., by the temperature component 128 or another temperature data mechanism). If necessary, the temperature information is converted to digital in step 404 (e.g., by the A/D converter 62).

At step 406, a determination is made whether the temperature is normal. That is, based upon the temperature data provided by the temperature component 128, the microcomputer determines whether an adjustment needs to be made to the heat output of the blanket 22 to compensate for the temperature at the time of the sensing the temperature. If the temperature is normal, say for example 70 degrees Fahrenheit, then step 406 branches to step 408, where the heat output of the blanket is set to the normal (i.e., non-temperature adjusted) output that corresponds to the user's setting. As one example, the user may have set the user control 36 to the setting "5," and the temperature is 70 degrees, which for this example is normal and is not temperature adjusted to account for ambient conditions. As such, using the example of operation of the controls of the warming fabric 20 described above, the heat output of the warming fabric is set to the normal setting for a "5," wherein power is cycled to the blanket 50% of the time. Such instructions are sent by the microcomputer 53 to the heat output component 50, which performs the functions of the microcomputer's instructions.

If the temperature is not normal, then step 406 branches to steps 410 and 412, where the heat output of the blanket is adjusted to account for the amount the temperature is varied from normal. As an example, beginning at step 410, an adjustment factor is calculated by the microcomputer 53 for the heat output of the warming fabric 22. The adjustment factor may use one of many mechanisms used by the microcomputer 53 to calculate an appropriate adjustment to the heat output. The adjustment factor may, for example, be looked up in a look-up table 52 by the microcomputer 53 using the voltage values from the A/D converter 62.

$$\text{Adjustment Factor} = \frac{70 - \text{Temperature}}{10}$$

$$\text{If} > 0.5\text{, then round up}$$

$$\text{If} < \text{or} = 0.5\text{, then round down}$$

$$-3 < \text{Adjustment Factor} < 3$$

In accordance with the above formula, the adjustment factor is calculated by subtracting the actual temperature from 70, and dividing the result by 10. If the result is a fraction greater than 0.5, the result is rounded up to the nearest whole number; otherwise the fraction is rounded down. In the example given, the adjustment factor is never greater than 2, or less than −2. Using this formula, the change in heat output from normal has a linear relationship to the change in temperature from normal.

As an example, the temperature of the room in which the warming fabric 20 is located may be 60 degrees. Applying the foregoing formula, the adjustment factor is: 70−60=10, divided by 10, equals 1. For 64, the result is the same: 70−64=6, divided by 10, equa which in the example is rounded up to 1. Application of the formula results in the adjustment factor being the following:

| Temperature | Adjustment Factor |
|---|---|
| Below 56 | 2 |
| 56 to 65 | 1 |
| 64 to 74 | 0 |
| 75 to 84 | −1 |
| 85 and up | −2 |

As can be understood, the above values may be calculated during operation by using an appropriate algorithm such as is set forth above, or the values may be stored and accessed via a look-up table (e.g., by converting voltage values from the A/D converter 62 to temperatures, and finding the adjustment factor that corresponds to the temperature). In accordance with one aspect of the present invention, when the user sets the user control 136 to the lowest setting, the adjustment factor does not adjust the heat output downward, regardless of the temperature. Likewise, when the user sets the user control 136 to the highest setting, the adjustment factor does not adjust the heat output upward.

The algorithm set forth above may be used to perform both steps 406 and 410, because it results in an adjustment factor of "0" when the temperature is "normal," and thus the output ends up being the user's setting. However, for ease of understanding, the flow process is described as shown in FIG. 4. It can be understood that the steps shown may be combined, performed in different orders, or that one or more of the steps may be skipped and the process may still fall under the present invention as defined in the claims below.

As one alterative to the above algorithm, instead of using a preselected "normal" temperature setting (e.g., 70 degrees), the ambient temperature at the user's setting of the blanket may be measured and treated as the normal temperature, and adjustments for variation in temperature may be made relative to the change from the measured "normal" temperature. The algorithm uses the setting that the user set (1 through 10) and the ambient temperature at the time of the setting as a base. The assumption is the user is comfortable at that setting and the particular ambient temperature. As time goes on, if the temperature in the room drops, the control senses this change and compensates by increasing the duty cycle of the controller. Conversely, if the room temperature increases the control compensates and keeps the user comfortable by decreasing the duty cycle. Effectively, this algorithm results in the same offset due to a change in temperature, but the algorithm does provide an alternate way of calculating the amount of compensation needed.

At step 412, the heat output is adjusted according to the adjustment factor by adding the adjustment factor to the user's setting. Using the embodiment described above, if the user sets the user control 136 to the setting "5," and the temperature is 62, then the output would be set to: 5+1=6. The heat output component 50 would therefore operate the blanket 122 at a heat output level that would be equal to the normal heat output level (i.e., 70 degree level) at 6 (e.g., power supplied to the heating element 24 for 60% of the time). Thus, the microcomputer 53 may be programmed to cause the blanket 22 to operate at a higher heat output at lower temperatures to provide more warming. This higher heat output has been found to compensate for the lower temperature the room, and feels to the user much like a blanket operating at the power level of 5 in a room that is 70 degrees.

In a similar manner, the microcomputer is programmed to cause the blanket 22 to operate at a lower heat output at higher temperatures to provide less warming. To this end, the negative adjustment factors, at temperatures higher than 74, cause the heat output to be adjusted to a lower setting, offsetting the warmer temperatures.

The process of adjusting the heat output to compensate for temperatures is preferably invisible to a user. Thus, in the example above, although the heat output for the warming fabric is adjusted to 6 from the user setting of 5, the display of the user control 136 or 36 still displays "5," because changing the display to the actual output may be confusing to a user.

After heat output is set (either at step 408 or step 412), then the process branches to step 414, where a determination is made whether it is time to check the temperature again. If so, the process branches back to step 402, where the temperature is sensed again. In this manner, the temperature compensation features of the present invention may be used in real time, so that adjustments may be made to heat output as the temperature changes. Additional temperature sensings may be made in set intervals, or by firing of events, in manners known in the art.

The present invention provides a warming fabric 20 that is capable of altering heat output to compensate for changes in ambient temperatures. The result is a warming fabric that feels approximately the same warmth at the same setting regardless of the ambient temperature. In this manner, the user is more comfortable and is not over or under-heated because of room temperature changes.

Many variations are possible. For example, as described above, the microcomputer 53 may use different ways of setting the amount of heat output. In addition, for the example above, the adjustment factor may adjust the heat output more than 2 settings. If desired, adjustments may even been made upward or downward when the user has set the user controls at the upper and lower settings, respectively, resulting in higher-than-normal heat output, if available, or, at the lower setting, perhaps turning the warming fabric off.

In addition, if the thermistor 54 is mounted in a control unit for the warming blanket, the electrical components in that control unit may cause the thermistor or any other temperature sensor to register a higher temperature than ambient. This higher temperature setting may be compensated by adjusting the setting of the warming blanket accordingly, for example by subtracting 5 degrees from the measured setting of the thermistor. Empirical data may be used to determine exactly the offset that is needed to compensate for the heat of the controls and to determine what output by the thermistor would be given at a particular ambient temperature. However, compensation may not be needed until the controls have been operating long enough to generate heat. Thus, compensation may occur after a specified amount of time, for example one hour, or after a sensed temperature of the controls reaches a particular temperature.

Although a preferred embodiment is described, many subsets of the components in the preferred embodiment may be used without the other components. For example, a warming fabric may utilize the temperature compensation components of the present invention, but not have user controls. In such an embodiment, a user does not have the option to change settings for the blanket (e.g., a single setting is fixed), but the heat output changes with changes in temperature. Moreover, although the various components are shown and described herein as separate components because of certain benefits resulting from separated functionality, it can be readily appreciated that some or all of the components may be combined into more complex components, and/or separated even further into additional components. As one example, more than one microcomputer may be used for the various functions described herein. However, that being said, one of the salient features of this invention is the fact that the temperature component may be incorporated in a printed circuit board with a microcomputer, thus minimizing cost and space needed for controls.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

What is claimed is:

1. A warming fabric, comprising:

a fabric;

a heating element associated with the fabric and configured to heat the fabric;

a data temperature mechanism configured to generate data regarding an ambient temperature of the fabric; and a microcomputer configured to set the level of heat output of the heating element based at least partly upon the data generated by the data temperature mechanism without resort to a direct temperature measurement of said fabric itself and without resort to a direct temperature measurement of said heating element.

2. The warming fabric of claim 1, wherein the microcomputer is further configured to set the level of heat output of the heating element based at least partly upon user input.

3. The warming fabric of claim 2, further comprising at least one user control, linked to the microcomputer, and for providing the user input.

4. The warming fabric of claim 1, wherein the microcomputer sets the level of heat output of the heating element at least partly by differentiating the temperature information relative to a particular temperature, and adjusting the level of heat output based upon a difference between the particular temperature and an ambient temperature of the fabric.

5. The warming fabric of claim 4, wherein the amount the heat output adjustment is substantially linear based upon the difference between the particular temperature and an ambient temperature of the fabric.

6. The warming fabric of claim 1, wherein the data temperature mechanism comprises a thermistor.

7. The warming fabric of claim 6, wherein the data temperature mechanism comprises a thermistor connected in series with a fixed-series resistor.

8. The warming fabric of claim 7, wherein the data regarding an ambient temperature comprises a voltage reading at a juncture of the thermistor and the fixed-series resistor.

9. The warming fabric of claim 8, further comprising an A/D converter for converting the voltage reading to digital.

10. The warming fabric of claim 8, wherein the microcomputer utilizes the voltage reading to set the heat output.

11. The warming fabric of claim 1, further comprising a control unit for housing the microcomputer and the data temperature mechanism.

12. The warming fabric of claim 11, wherein the microcomputer sets the level of heat output of the heating element at least partly by accounting for temperature generation within the control unit.

13. The warming fabric of claim 12, wherein the microcomputer accounts for temperature generation by lowering the output setting for a particular reading by the data temperature mechanism after the control unit has been operating a particular amount of time.

14. The warming fabric of claim 13, wherein the particular amount of time is approximately an hour.

15. A control for a warming fabric, comprising:

a data temperature mechanism configured to generate data regarding an ambient temperature of a warming fabric; and a microcomputer configured to set the level of heat output of the warming fabric based at least partly upon the data generated by the data temperature mechanism without resort to a direct temperature measurement of said fabric itself and without resort to a direct temperature measurement of said heating element.

16. The control of claim 15, wherein the microcomputer is further configured to set the level of heat output based at least partly upon user input.

17. The control of claim 16, further comprising at least one user control, linked to the microcomputer, and for providing the user input.

18. The control of claim 15, wherein the microcomputer sets the level of heat output at least partly by differentiating the temperature information relative to a particular temperature, and adjusting the level of heat output based upon a difference between the particular temperature and an ambient temperature of the fabric.

19. The control of claim 18, wherein the amount the heat output adjustment is substantially linear based upon the difference between the particular temperature and an ambient temperature of a warming fabric.

20. The control of claim 15, wherein the data temperature mechanism comprises a thermistor.

21. The control of claim 20, wherein the data temperature mechanism comprises a thermistor connected in series with a fixed-series resistor.

22. The control of claim 21, wherein the data regarding an ambient temperature comprises a voltage reading at a juncture of the thermistor and the fixed-series resistor.

23. The control of claim 22, further comprising an A/D converter for converting the voltage reading to digital.

24. The control of claim 22, wherein the microcomputer utilizes the voltage reading to set the heat output.

25. The warming fabric of claim 15, further comprising a control unit for housing the microcomputer and the data temperature mechanism.

26. The warming fabric of claim 25, wherein the microcomputer sets the level of heat output of the heating element at least partly by accounting for temperature generation within the control unit.

27. The warming fabric of claim 26, wherein the microcomputer accounts for temperature generation by lowering the output setting for a particular reading by the data temperature mechanism after the control unit has been operating a particular amount of time.

28. The warming fabric of claim 27, wherein the particular amount of time is approximately an hour.

29. A warming blanket system, comprising:

a fabric comprising a heating element;

a data temperature mechanism configured to provide ambient air temperature data;

a user input configured to provide user heat output preference data for a given normal ambient temperature; and a control system configured to input said air temperature and user heat output preference data and adjust heat output to said heating element based upon a deviation of a measured ambient temperature from said normal ambient temperature without resort to a direct temperature measurement of said fabric itself and without resort to a direct temperature measurement of said heating element.

30. The apparatus of claim 29 wherein said normal temperature is a predetermined value.

31. The apparatus of claim 29 wherein said normal ambient temperature is set as the ambient temperature measured at the time the user last made an adjustment to said user input.

* * * * *